US012096795B2

(12) United States Patent
Liu

(10) Patent No.: US 12,096,795 B2
(45) Date of Patent: Sep. 24, 2024

(54) ATOMIZER AND ELECTRONIC CIGARETTE COMPRISING THE SAME

(71) Applicant: Shenzhen Eigate Technology Co., Ltd., Shenzhen (CN)

(72) Inventor: Tuanfang Liu, Shenzhen (CN)

(73) Assignee: SHENZHEN EIGATE TECHNOLOGY CO., LTD., Shenzhen (CN)

( * ) Notice: Subject to any disclaimer, the term of this patent is extended or adjusted under 35 U.S.C. 154(b) by 407 days.

(21) Appl. No.: 17/519,514

(22) Filed: Nov. 4, 2021

(65) Prior Publication Data

US 2022/0369709 A1 Nov. 24, 2022

(30) Foreign Application Priority Data

May 22, 2021 (CN) ..... 202110561319.1
May 22, 2021 (CN) ..... 202121125129.7

(51) Int. Cl.

| | |
|---|---|
| ***A24F 40/42*** | (2020.01) |
| ***A24F 40/10*** | (2020.01) |
| ***A24F 40/44*** | (2020.01) |
| ***A24F 40/46*** | (2020.01) |
| ***A24F 40/485*** | (2020.01) |

(52) U.S. Cl.

CPC ..... *A24F 40/42* (2020.01); *A24F 40/10* (2020.01); *A24F 40/44* (2020.01); *A24F 40/46* (2020.01); *A24F 40/485* (2020.01)

(58) Field of Classification Search

CPC ..... A24F 40/10; A24F 40/42; A24F 40/485; A24F 40/48; A24F 15/015; A24F 40/30; A24F 7/00

See application file for complete search history.

(56) References Cited

U.S. PATENT DOCUMENTS

| | | | | |
|---|---|---|---|---|
| 2014/0109921 | A1* | 4/2014 | Chen | A24F 40/44 131/273 |
| 2015/0034104 | A1* | 2/2015 | Zhou | A61M 15/02 131/329 |
| 2022/0248757 | A1* | 8/2022 | Guo | A24F 40/42 |
| 2022/0354174 | A1* | 11/2022 | Liu | A24F 40/46 |
| 2022/0361570 | A1* | 11/2022 | Liu | A24F 40/10 |
| 2024/0041109 | A1* | 2/2024 | Deng | A24F 40/42 |

FOREIGN PATENT DOCUMENTS

| | | | | |
|---|---|---|---|---|
| WO | WO 2017/163052 | * | 9/2017 | A24F 40/44 |

* cited by examiner

*Primary Examiner* — Truc T Nguyen
(74) *Attorney, Agent, or Firm* — MATTHIAS SCHOLL P.C.; Matthias Scholl

(57) ABSTRACT

An atomizer includes an e-liquid tank and a seal member. The e-liquid tank includes a cavity and an airflow channel. The seal member is disposed on one end of the e-liquid tank. The seal member includes a groove configured to equalize a pressure in the e-liquid tank with outside pressure. Both ends of the groove communicate with the cavity and the airflow channel, respectively.

10 Claims, 7 Drawing Sheets

ATOMIZER AND ELECTRONIC CIGARETTE COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 202110561319.1 filed May 22, 2021, and to Chinese Patent Application No. 202121125129.7 filed May 22, 2021. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to an atomizer and an electronic cigarette comprising the same.

After atomization, a negative pressure is generated and maintained in the e-liquid tanks of conventional atomizers. If no air is supplemented to the e-liquid tanks, the e-liquid cannot flow to the e-liquid absorbent member, which may burn out the heating elements. When the e-cigarette vapor cools down, it condenses into liquid and flows through air inlets or airflow channels out of the atomizer, thus staining the atomizer.

In addition, conventional e-liquid tanks include side walls provided with holes or grooves for the balance of air pressure. If the holes or the grooves are too small, it is difficult to process the holes or grooves and the airflow is not smooth. If the holes or grooves are too large, the e-liquid may leak.

SUMMARY

The first objective of the disclosure is to provide an atomizer; the atomizer comprises an e-liquid tank and a seal member; the e-liquid tank comprises a cavity and an airflow channel; the seal member is disposed on one end of the e-liquid tank; the seal member comprises a groove configured to equalize a pressure in the e-liquid tank with outside pressure; both ends of the groove communicate with the cavity and the airflow channel, respectively; when the seal member abuts against the e-liquid tank, the groove is squeezed into a smaller groove, thus making the groove easier to be manufactured and preventing leakage of the e-liquid.

In a class of this embodiment, the e-liquid tank comprises a distal end, a mouthpiece, and an air conduction tube; the distal end is away from the seal member and the mouthpiece is disposed on the distal end; the air conduction tube extends from the mouthpiece into the e-liquid tank; the air conduction tube constitutes a whole or a part of the airflow channel and is connected to the seal member; the groove is disposed at a wall junction between the seal member and the air conduction tube.

In a class of this embodiment, the seal member comprises a first main body and a second main body; the second main body is hollow and has a reduced diameter than the first main body; the air conduction tube is disposed through the second main body into the first main body, so that an inner wall of the second main body abuts against an outer wall of the air conduction wall; the groove is disposed on the inner wall of the second main body; an air duct is defined by the groove and the outer wall of the air conduction tube to equalize the pressure in the cavity with the outside pressure while preventing leakage of the e-liquid.

In a class of this embodiment, the second main body comprises a sidewall and at least one e-liquid inlet disposed on the sidewall; the e-liquid absorbent member comprises a heating element and is disposed in the second main body; at least one end of the e-liquid absorbent member abuts against an edge of the at least one e-liquid inlet; the air conduction tube abuts against the e-liquid absorbent member; and/or the air conduction tube comprises a proximal end abutting against the seal member; the air conduction tube further comprises a notch disposed on the proximal end and communicating with the groove; when the air conduction tube abuts against the e-liquid absorbent member, the e-liquid flows into the e-liquid adsorption member and is atomized by the heating element to produce aerosol; the aerosol passes through the air conduction tube into the mouthpiece, and is inhaled by a user; when the user does not inhale on the mouthpiece, the e-liquid absorbent member absorbs the e-liquid and expands, thus eliminating a gap between the e-liquid absorbent member and the air conduction tube and preventing leakage of the e-liquid; when the use inhales on the mouthpiece, the e-liquid in the e-liquid absorbent member is heated and the e-liquid absorbent member shrinks to form the gap between the e-liquid absorbent member and the air conduction tube, so that outside air is supplied to the cavity to facilitate the absorption of the e-liquid by the e-liquid absorbent member; the e-liquid absorbent member can absorb a small amount of the e-liquid leaking from the gap, thus preventing leakage of the e-liquid.

In a class of this embodiment, one end of the groove extends through an upper opening of the second main body into the cavity; the other end of the groove extends at least to the wall junction between the seal member and the air conduction tube, thus achieving air supplement and emission.

In a class of this embodiment, the groove has a depth of 0.01-0.5 mm, preferably 0.05-0.4 mm, and more preferably 0.1-0.3 mm; and the groove has a width of ≤3 mm, preferably ≤2 mm, and more preferably ≤1 mm; and/or, the seal member comprises latex, rubber, silica gel, or plastic; most preferably, the groove has a depth of 0.2 mm and a width of 0.5 mm to ensure that the groove allows only gas to flow into the cavity while preventing the passage of the e-liquid, thus facilitating air supplement.

In a class of this embodiment, the second main body further comprises two e-liquid inlets disposed on the sidewall and opposite to one another; the second main body further comprises two slots disposed on the sidewall and opposite to one another; the two slots are disposed under the two e-liquid inlets, respectively; both ends of the e-liquid absorbent member are disposed in the two slots and abuts against the inner wall of the second main body to block the two e-liquid inlets; preferably, the two e-liquid inlets are symmetrically disposed on the sidewall of the second main body to increase absorption of the e-liquid; the two slots are separately in the shape of "U".

In a class of this embodiment, the seal member comprises rubber.

In a class of this embodiment, the e-liquid absorbent member comprises a porous material.

In a class of this embodiment, the e-liquid absorbent member comprises an e-liquid absorbent cotton, or a piece of cotton wrapped about a ceramic body member; the seal member comprises latex, plastic, silica gel, or rubber; the e-liquid absorbent cotton and the cotton wrapped about the ceramic body member independently comprise linen cotton, organic cotton, or composite cotton; the heating element is configured to atomize the e-liquid and comprises iron, chromium, nickel, or alloy metal.

In a class of this embodiment, the atomizer further comprises a fixing member and the e-liquid tank comprises a bottom portion away from the mouthpiece; the fixing member cooperates with the bottom portion of the e-liquid tank to form an air conduction space; the fixing member comprises a peripheral wall, a recess portion, at least one first air inlet, and at least one second air inlet; the at least one first air inlet and the at least one second air inlet are disposed on the peripheral wall, and communicate with the air conduction space; and the at least one first air inlet communicates with the recess portion.

In a class of this embodiment, the fixing member further comprises a base bottom and a third air inlet disposed on the base portion; the atomizer further comprises a first electrode and a second electrode both disposed on the base portion and electrically connected to the heating element; both ends of the third air inlet communicate with the second air inlet and atmosphere, respectively.

In a class of this embodiment, the e-liquid absorbent member is disposed horizontally in the second main body to provide a smoother airflow and increase heating area, thus maximizing the amount of the smoke produced; the heating element is wound around a middle portion of the e-liquid absorbent member; the heating element and the middle portion of the e-liquid absorbent member are exposed in the air conduction tube.

One second objective of the disclosure is to provide an electronic cigarette; the electronic cigarette comprises the atomizer and a battery assembly; the atomizer is formed integrally with, fixedly connected to, or detachably connected to the battery assembly.

The following advantages are associated with the atomizer and the electronic cigarette of the disclosure: the atomizer comprises the groove disposed in the seal member; when the seal member abuts against the e-liquid tank, the groove is squeezed into a smaller groove, so that the e-liquid tank holds enough air to provide sufficient pressure for a smoother airflow; the smooth airflow facilitates the absorption of the e-liquid by the e-liquid absorbent member while preventing leakage of the e-liquid and the e-liquid absorbent member from burning out.

Figure 1:
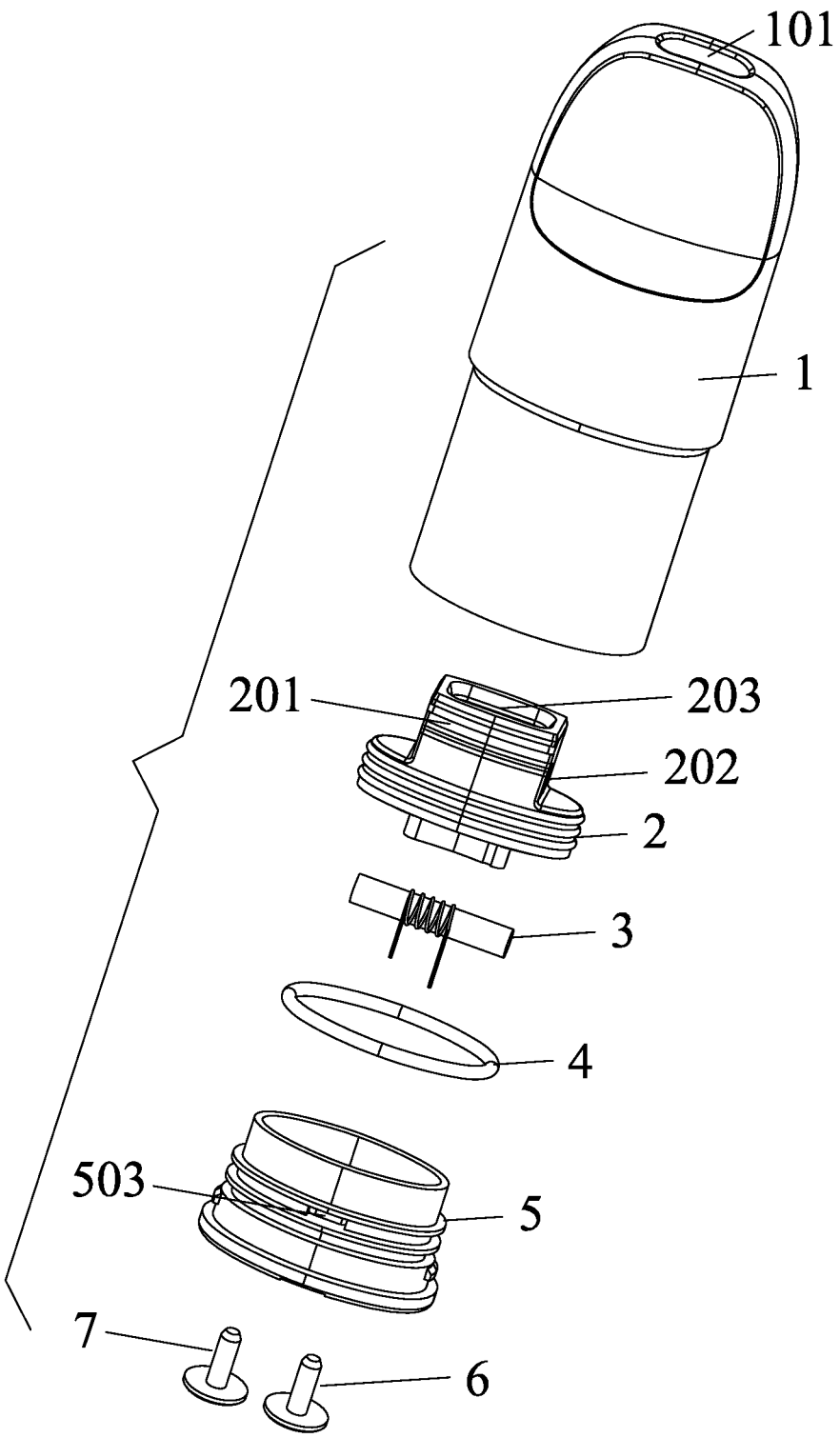
FIG. 1 is an exploded view of an atomizer according to one embodiment of the disclosure.
Figure 2:
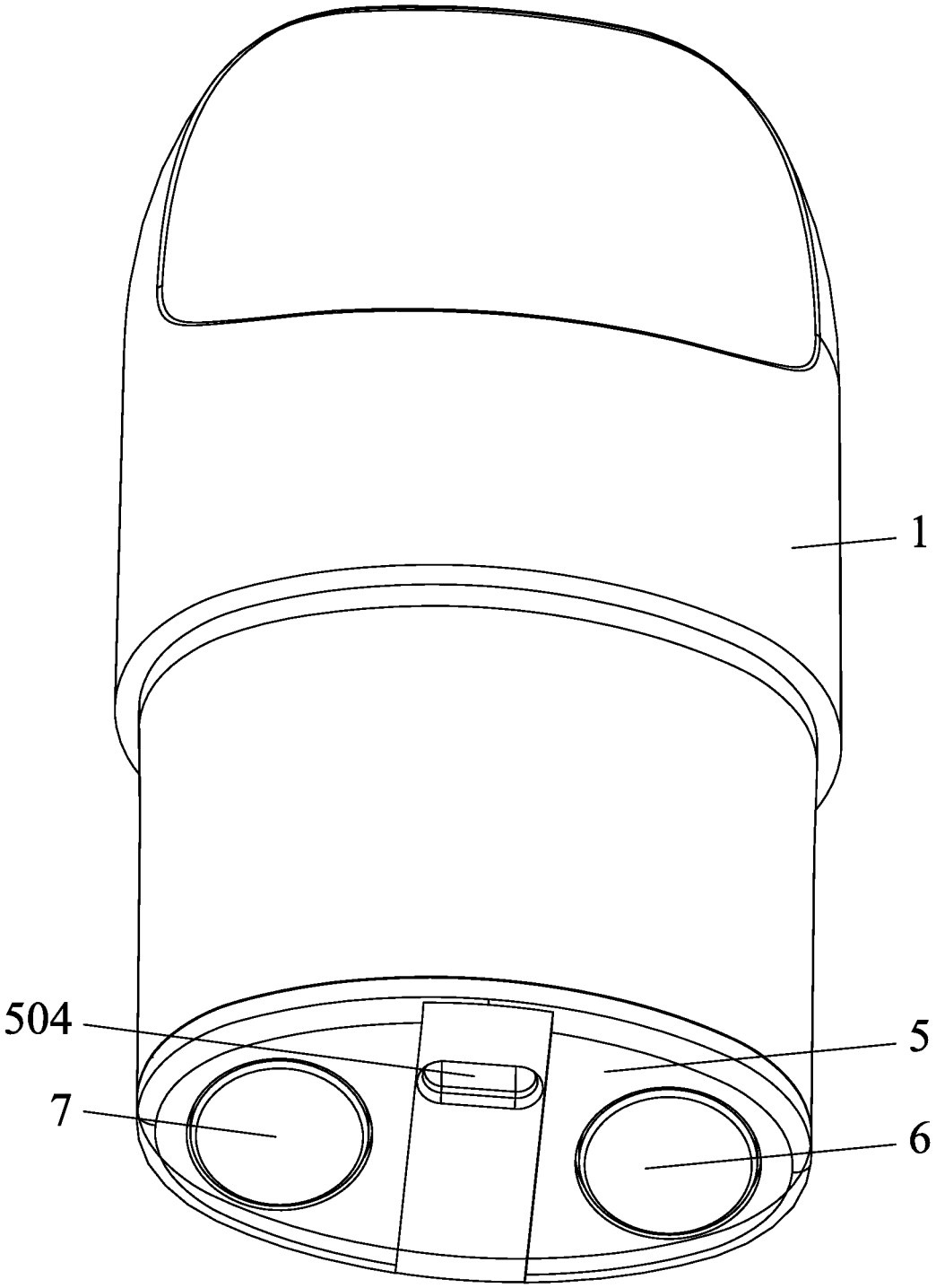
FIG. 2 is a perspective view of an atomizer according to one embodiment of the disclosure.
Figure 3:
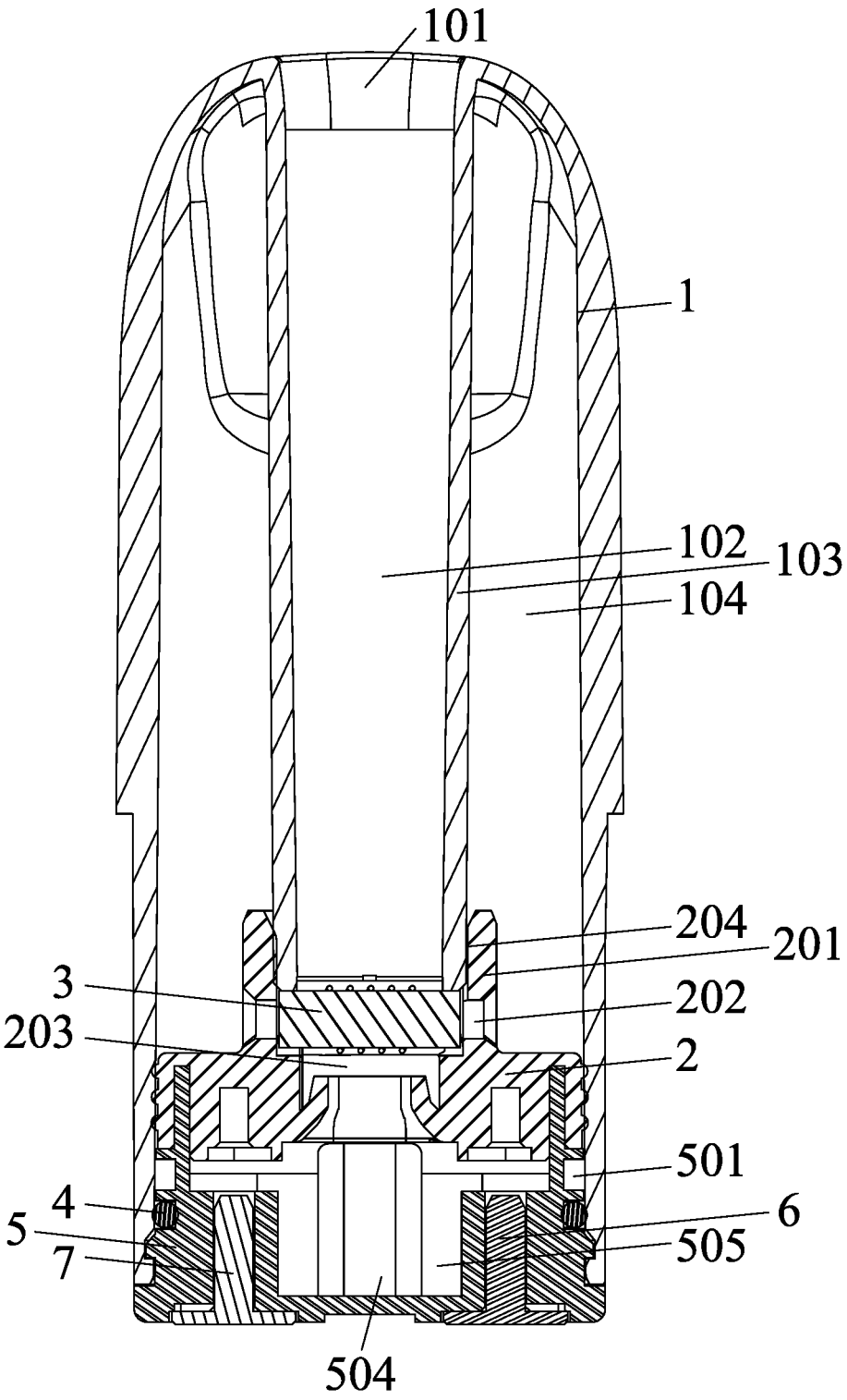
FIG. 3 is a first cross-sectional view of an atomizer according to one embodiment of the disclosure.
Figure 4:
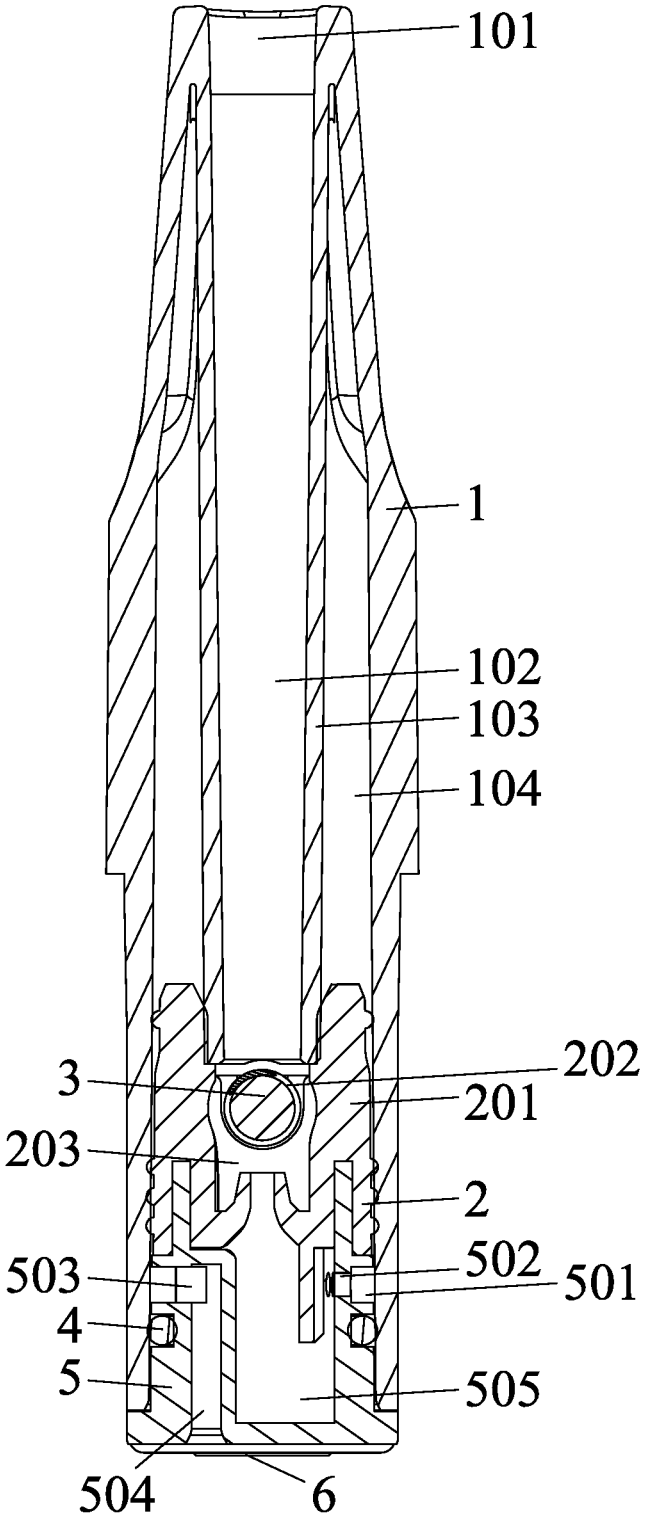
FIG. 4 is a second cross-sectional view of an atomizer according to one embodiment of the disclosure.

In the drawings, the following reference numbers are used: 1. E-liquid tank; 2. Seal member; 3. E-liquid absorbent member; 4. Seal ring; 5. Fixing member; 6. First electrode; 7. Second electrode; 101. Mouthpiece; 102. Air conduction channel; 103. Air conduction tube; 104. Cavity; 201. Second main boy; 202. E-liquid inlet; 203. Atomizing channel; 204. Groove; 501. Air conduction space; 502. First air inlet; 503. Second air inlet; 504. Third air inlet; 505. Recess portion; and 900. Slot.

DETAILED DESCRIPTION

To further illustrate the disclosure, embodiments detailing an atomizer and an electronic cigarette comprising the same are described below. It should be noted that the following embodiments are intended to describe and not to limit the disclosure.

Referring to FIGS. 1-4, an atomizer comprises an e-liquid tank 1, a seal member 2, an e-liquid absorbent member 3, a seal ring 4, a fixing member 5, a first electrode 6, and a second electrode 7. A cavity 104 is formed in the e-liquid tank 1 and the seal member 2 is disposed into a bottom end of the e-liquid tank 1 to seal the cavity 104. The e-liquid tank 1 comprises an air conduction tube 3 for air conduction and emission. The seal member 2 comprises an atomizing channel 203 communicating with the air conduction tube 203. The seal member 2 further comprises a groove 204 comprising a side wall. An air duct is defined by a side wall of the groove 204 and an outer wall of the air conduction tube 103, thus allowing air to flow through. The air conduction tube 3 comprises a hollow column functioning as an air conduction channel 102. Both ends of the supply tube communicate with the cavity 104 and the air conduction channel 102, respectively. The e-liquid tank 1 comprises an open top functioning as a mouthpiece 101. The mouthpiece 101 communicates with the air conduction channel 102. External air flows through the mouthpiece 101, the air conduction channel 102, the air duct, and into the cavity 104, so that the e-liquid tank 1 holds enough air to provide sufficient pressure for a smoother airflow. The air duct allows only air to pass through while preventing the passage of the e-liquid in the cavity 104. The fixing member 5 is disposed under the seal member 2 and comprises a recess portion 505. The fixing member 5 abuts against a bottom portion of the e-liquid tank 1 to form an air conduction space 501. The fixing member 5 comprises a peripheral wall, a first air inlet 502, a second air inlet 503. The two air inlets are disposed both on the peripheral wall and in the air conduction space 501. The first air inlet 502 is disposed above and communicates with the second air inlet 503. The fixing member 5 further comprises a base portion and a third air inlet 504 disposed on the base portion and communicating with the second air inlet 503. The seal member 2 further comprises a narrow neck as a second main body 201. Both ends of the second main body separately comprises an e-liquid inlet 202 communicating with the atomizing channel 203. The e-liquid absorbent member 3 is disposed in the atomizing channel 203 to atomize the e-liquid. Both ends of the e-liquid absorbent member 3 separately abuts against an edge of the corresponding e-liquid inlet 202 to communicate with the cavity 104. A middle portion of the e-liquid absorbent member 3 is disposed under the air conduction channel 102. The e-liquid in the cavity 104 flows through both ends of the e-liquid absorbent member 3 into the middle portion of the e-liquid absorbent member 3 and is atomized to produce e-cigarette vapor or smoke. The seal ring 4 is disposed between the fixing member 5 and the e-liquid tank 1 to seal the air conduction space 501. The e-liquid absorbent member 3 comprises a positive pin and a negative pin.

The first electrode 6 and the second electrode 7 are separately disposed in the middle of the fixing member 5 to make electrical contact with the positive and negative pins.

Figure 5:
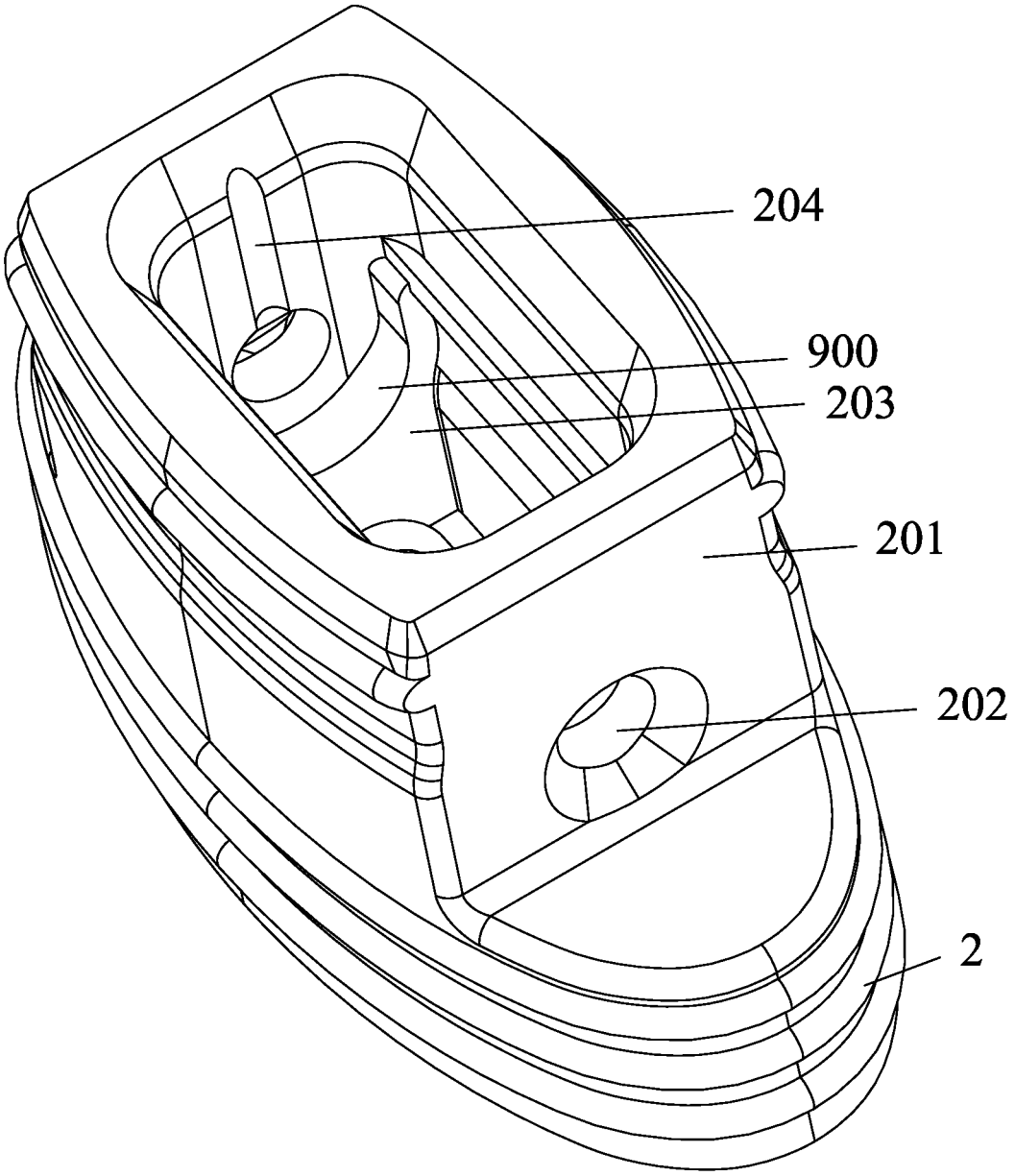
FIG. 5 is a perspective view of a seal member according to one embodiment of the disclosure.

FIG. 5 is a perspective view of the seal member 2 comprising the groove 204 and the e-liquid inlet 202 according to certain embodiment of the disclosure. The second main body 201 comprises two slots 900 configured to support the e-liquid absorbent member 3.

Figure 6:
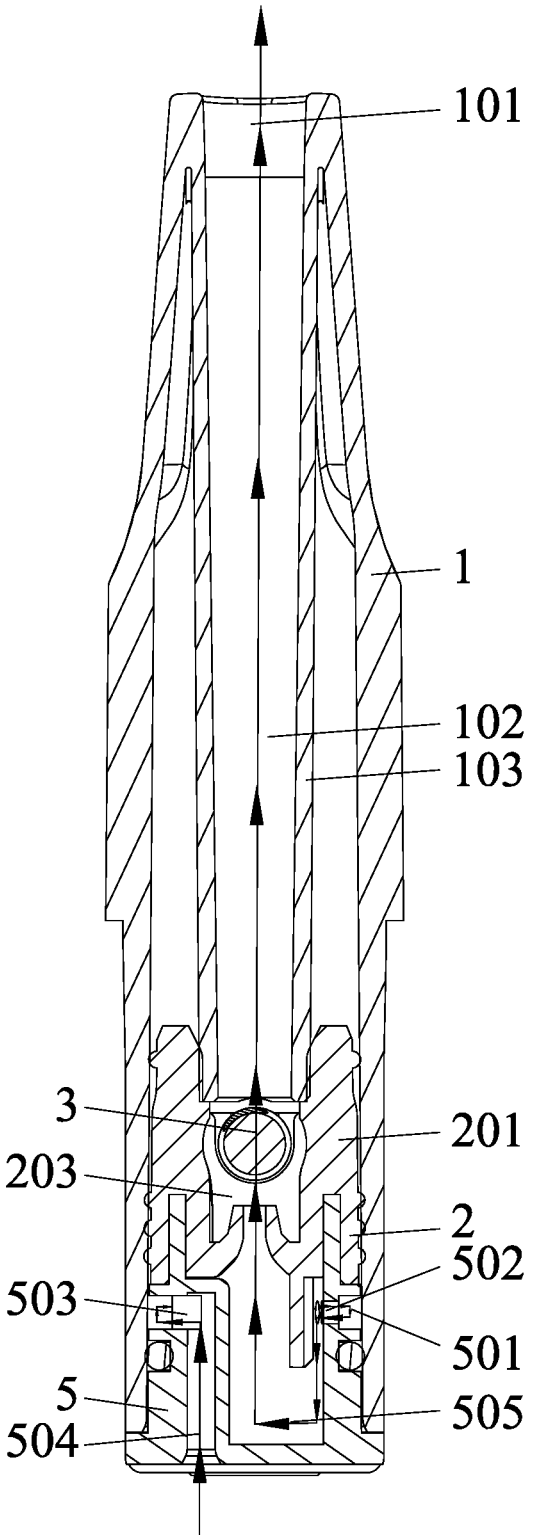
FIG. 6 is a cross-sectional view including arrows showing the direction of airflow in an atomizer according to certain embodiment of the disclosure.

FIG. 6 is a cross-sectional view including arrows showing the direction of airflow in the atomizer of the disclosure. External air flows through the third air inlet 504, the second air inlet 503, the air conduction space 501, the first air inlet 502, the recess portion 505, and the atomizing channel 203, causing the e-liquid absorbent member 3 to atomize the e-liquid. The e-cigarette vapor or smoke flows through the air conduction channel 102, enters the mouthpiece 101, and is inhaled by a user.

Figure 7:
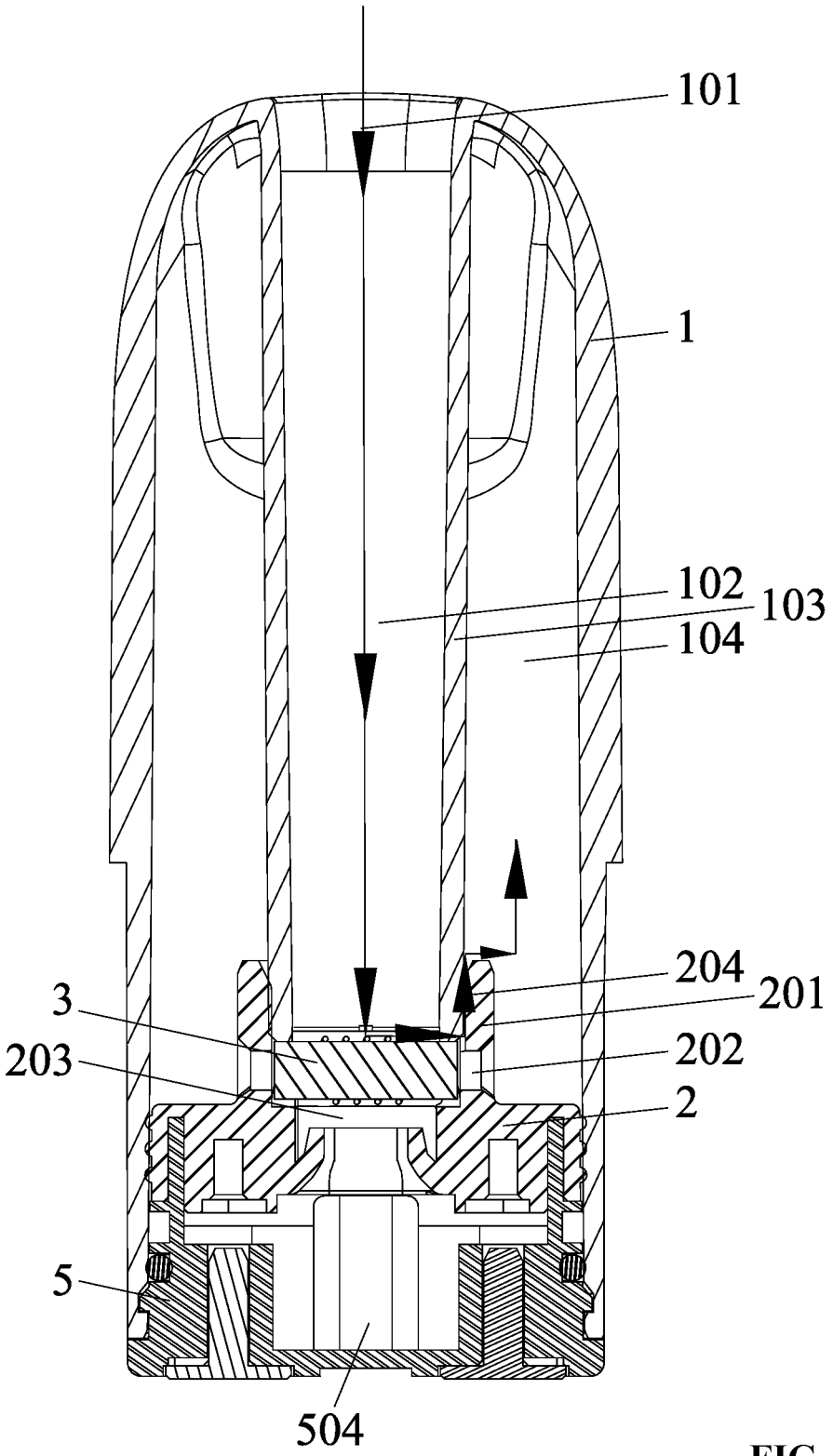
FIG. 7 is a cross-sectional view including arrows showing the flow direction of the air supplied from outside according to certain embodiment of the disclosure.

FIG. 7 is a cross-sectional view including arrows showing the flow direction of the air supplied from outside according to certain embodiment of the disclosure. External air flows through the mouthpiece, air conduction channel 102, the air duct, and into the cavity 104, so that the e-liquid tank 1 holds enough air to provide sufficient pressure for a smoother airflow.

It will be obvious to those skilled in the art that changes and modifications may be made, and therefore, the aim in the appended claims is to cover all such changes and modifications.

The invention claimed is:

1. An atomizer, comprising an e-liquid tank and a seal member; wherein the e-liquid tank comprises a cavity; the seal member is disposed on one end of the e-liquid tank; the seal member comprises a groove configured to equalize a pressure in the e-liquid tank with outside pressure;

the e-liquid tank comprises a distal end, a mouthpiece, and an air conduction tube; the distal end is away from the seal member and the mouthpiece is disposed on the distal end; the air conduction tube extends from the mouthpiece into the e-liquid tank; the air conduction tube is connected to the seal member; and the groove is disposed at a wall junction between the seal member and the air conduction tube; and the seal member comprises a first main body and a second main body; the second main body is hollow and has a reduced diameter than the first main body; the air conduction tube is disposed through the second main body into the first main body, so that an inner wall of the second main body abuts against an outer wall of the air conduction wall; the groove is disposed on the inner wall of the second main body.

2. The atomizer of claim 1, wherein the second main body comprises a sidewall and at least one e-liquid inlet disposed on the sidewall; an e-liquid absorbent member comprises a heating element and is disposed in the second main body; at least one end of the e-liquid absorbent member abuts against an edge of the at least one e-liquid inlet; the air conduction tube abuts against the e-liquid absorbent member; and/or the air conduction tube comprises a proximal end abutting against the seal member; the air conduction tube further comprises a notch disposed on the proximal end and communicating with the groove.

3. The atomizer of claim 2, wherein one end of the groove extends through an upper opening of the second main body into the cavity; the other end of the groove extends at least to the wall junction between the seal member and the air conduction tube.

4. The atomizer of claim 1, wherein the groove has a depth of 0.01-0.5 mm and a width of ≤3 mm.

5. The atomizer of claim 1, wherein the second main body further comprises two e-liquid inlets disposed on the sidewall and opposite to one another; the second main body further comprises two slots disposed on the sidewall and opposite to one another; the two slots are disposed under the two e-liquid inlets, respectively; both ends of the e-liquid absorbent member are disposed in the two slots and abuts against the inner wall of the second main body to block the two e-liquid inlets.

6. The atomizer of claim 2, wherein the seal member comprises rubber; and/or the e-liquid absorbent member comprises a porous material; and/or the e-liquid absorbent member comprises an e-liquid absorbent cotton, or a piece of cotton wrapped about a ceramic body member.

7. The atomizer of claim 5, wherein the atomizer further comprises a fixing member and the e-liquid tank comprises a bottom portion away from the mouthpiece; the fixing member cooperates with the bottom portion of the e-liquid tank to form an air conduction space; the fixing member comprises a peripheral wall, a recess portion, at least one first air inlet, and at least one second air inlet; the at least one first air inlet and the at least one second air inlet are disposed on the peripheral wall, and communicate with the air conduction space; and the at least one first air inlet communicates with the recess portion.

8. The atomizer of claim 7, wherein the fixing member further comprises a base portion and a third air inlet disposed on the base portion; the atomizer further comprises a first electrode and a second electrode both disposed on the base portion and electrically connected to the heating element; both ends of the third air inlet communicate with the second air inlet and atmosphere, respectively.

9. The atomizer of claim 8, wherein the e-liquid absorbent member is disposed horizontally in the second main body; the heating element is wound around a middle portion of the e-liquid absorbent member; and the heating element and the middle portion of the e-liquid absorbent member are exposed in the air conduction tube.

10. An electronic cigarette, comprising the atomizer of claim 1 and a battery assembly.

* * * * *